United States Patent [19]

Korber, Jr.

[11] Patent Number: 4,965,539

[45] Date of Patent: Oct. 23, 1990

[54] MICROWAVE NOTCH FILTER USING PIN DIODE SHUNTED YIG RESONATORS

[75] Inventor: Marinus L. Korber, Jr., San Carlos, Calif.

[73] Assignee: Watkins-Johnson Company, Palo Alto, Calif.

[21] Appl. No.: 360,312

[22] Filed: Jun. 2, 1989

[51] Int. Cl.[5] ..... H01P 1/20; H01P 1/218

[52] U.S. Cl. ..... 333/202; 333/176; 333/219.2

[58] Field of Search ..... 333/219.2, 202, 176, 333/235, 103; 331/96

[56] References Cited

U.S. PATENT DOCUMENTS

| | | | |
|---|---|---|---|
| 3,973,204 | 8/1976 | Keiter | 333/202 X |
| 4,420,731 | 12/1983 | Schiebold et al. | 333/219.2 |
| 4,554,516 | 11/1985 | Basawapatna | 333/219.2 X |
| 4,633,205 | 12/1986 | Jones | 333/219.2 |

*Primary Examiner*—Eugene R. LaRoche
*Assistant Examiner*—Seung Ham
*Attorney, Agent, or Firm*—Flehr, Hohbach, Test, Albritton & Herbert

[57] ABSTRACT

Disclosed is a microwave notch filter which includes a plurality of serially connected YIG tuned resonators, each YIG resonator including a coupling wire and a PIN diode connected in parallel with the coupling wire. A first interconnect interconnects one end of the plurality of serially connected YIG resonators to an RF signal source, and a second inter-connect interconnects another end of the plurality of serially connected YIG band reject filters to a load. An inductor connects one of the interconnects to a circuit ground potential, and an inductor means connects the other interconnect to a DC voltage source, whereby the PIN diodes in the YIG resonators can be forward-biased or reverse-biased by an applied DC voltage. The DC voltage source selectively provides a positive DC voltage and a negative DC voltage which effectively controls the functioning of said YIG band reject filters. The PIN diodes are serially connected with like polarities whereby application of a negative voltage reverse-biases said diodes and application of a positive voltage causes said diodes to short-circuit said YIG resonators.

7 Claims, 5 Drawing Sheets

MICROWAVE NOTCH FILTER USING PIN DIODE SHUNTED YIG RESONATORS

BACKGROUND OF THE INVENTION

This invention relates generally to microwave filters, and more particularly the invention relates to microwave notch filters employing YIG resonators.

Yttrium iron garnet (YIG) spheres serve as resonators in a host of magnetically tuned microwave devices such as YIG tuned oscillators, bandpads filters, band rejection filters, limiters, and discriminators. The YIG has high-quality (Q), inherent tuning linearity, extremely broad tuning range, good temperature stability, manageable spurious response, and small size. These characteristics make the YIG an ideal tuning element for microwave devices such as notch filters or band reject filters.

In a notch filter, a single YIG resonator typically will not supply the rejection characteristics required for modern sophisticated electronic systems. Therefore, it is standard practice to use multiple resonators to achieve usable stop band shape. A typical four-section filter may tune from 8 to 18 GHz with a 40 dB rejection bandwidth of 10 MHz, a 200 MHz maximum 3 dB bandwidth, and a passband insertion loss of 1 dB.

Electronically tunable microwave band rejection or notch filters have wide application whenever an undesired signal must be isolated, or rejected, from an electronic system. A typical application might be as a self-protecting jammer protecting an airborne broadband receiver from the aircraft's fire control radar or radars which may hop from one frequency to another frequency very quickly. As the rad-ar hops around, the notch must be tuned to the new frequency, thereby jamming it and protecting the receiver from overload, while any signal outside the notch can be received and analyzed unattenuated. Accordingly, it is often desirable to remove the notch from the band very quickly (i.e. less than 500 ns). In the case of a YIG filter, this cannot be accomplished by merely reducing the tuning coil current. The magnetic core inductance is such that time constants on the order of 50 ms are required to reduce the magnetic field strength through the YIG spheres, and consequently the resonant frequency of the notch to a level below the operating band. For this reason, another technique of disabling the notch has heretofore been in use.

The conventional solution has been to place the filter between two single-pole double-throw (SPDT) PIN diode transfer switches. The notch can be switched off (bypassed) at a very fast rate. However, there are several disadvantages to this approach including additional insertion loss from the switches, catastrophic failure if DC power is lost to the switch, and a single diode failure can render the switches and hence the receiver system inoperable.

SUMMARY OF THE INVENTION

An object of the present invention is an improved microwave notch filter using YIG filters.

Another object of the invention is a microwave filter using a YIG filter having reduced insertion loss.

Still another object of the invention is a microwave filter in which the possibility of catastrophic failure is reduced.

A feature of the invention is the use of a plurality of serially-connected YIG resonators, with each YIG resonator being shunted by a PIN diode switch.

Briefly, by shunting each YIG filter with a PIN diode, each resonator can be effectively shunted when the diode is biased on, yet the PIN diodes are effectively invisible when the diodes are biased off.

A diode failure in the form of an open or shorted diode will affect the degree to which the notch is disabled, but leaves the passband basically unaffected. A loss of DC power simply leaves the diodes unbiased and the filter operates normally.

The invention and objects and features thereof will be more readily apparent from the following detailed description and appended claims when taken with the drawing.

Detailed Description of Illustrative Embodiments

Figure 1A:
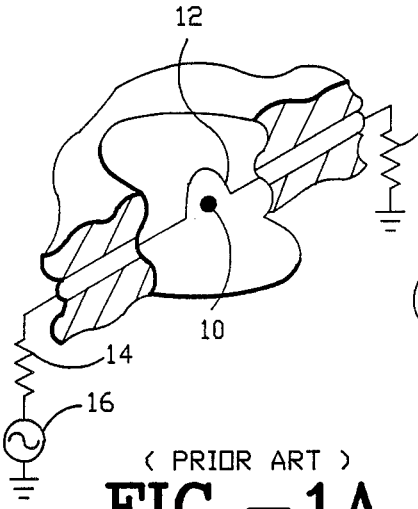
( PRIOR ART ) FIG.—1A
FIGS. 1A, 1B and 1C are a perspective view in section of a conventional YIG filter, an equivalent electrical schematic of the YIG filter, and the frequency characteristics thereof, respectively.

Referring now to the drawing, FIG. 1A is a perspective view in section of a YIG tuned band reject filter in accordance with the prior art. A YIG spherical resonator 10 sits inside a halfwire coupling loop 12 in the cavity of a metal circuit block 14 which is positioned in a magnetic field, B. Opposing ends of the loop are attached to a length of transmission line, one side attached to an RF power source 16 and the other terminated in a 50 ohm load 18. The wire loop 12 represents an inductive discontinuity in the power flow between the source and load, the typical coupling inductance being on the order of 1 nh. Hence the line length before and after the loop is used as a matching network to ensure maximum source-to-load power transfer. The YIG sphere is electrically invisible until the structure is placed in the DC magnetic field. The normally random orientation of the magnetic dipoles within the sphere align with the DC magnetic field. When the internal field of the sphere is of sufficient strength to align all the electron spins, the sphere is said to be saturated. When an RF magnetic field produced by the RF current moving through the wire coupling loop is applied at right angles to the DC field, a precession of the electron spin about the axis of the DC magnetic field takes place. This precession rate occurs at 2.8 MHz/Gauss of applied external DC field and is called the ferromagnetic resonant frequency. The precessing electrons act as small bar magnets, precessing in unison with the time bearing magnetic field inducing a voltage on the RF coupling loop such as to force a current flow opposite to the initial current flow. If the sphere Q were infinite, then all the energy coupled into the sphere would be reflected back to the coupling loop and the input impedance would appear infinite at resonance. Outside of resonance, the sphere and all of its ferromagnetic effects are basically invisible. However, since the YIG resonator has a finite Q, the degree to which the source current is cancelled and prevented from being delivered to the load will vary as a function of resonator Q and tightness of coupling to the wire loop. Consequently, the notch depth and width at various reflection levels will depend on coupling and sphere quality.

Figure 1B:
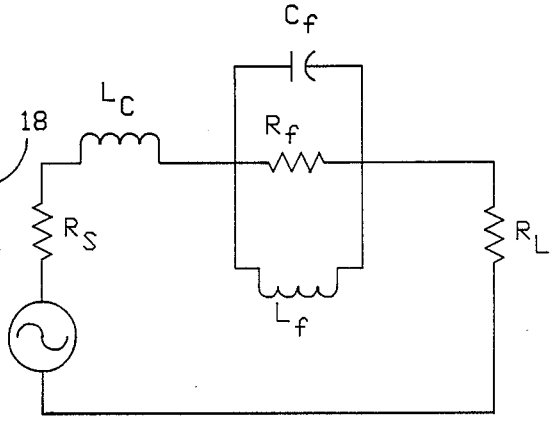
( PRIOR ART ) FIG.—1B
Figure 1C:
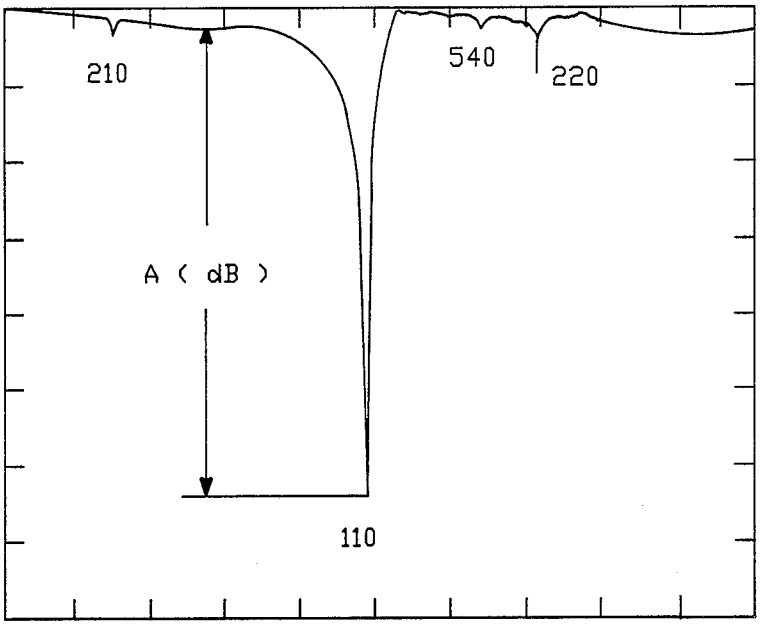
( PRIOR ART ) FIG.—1C

FIG. 1B is an equivalent electrical schematic of the YIG filter illustrated as a parallel RLC network with intrinsic element values being a function of various sphere and coupling properties. The frequency response of the YIG resonator is illustrated in FIG. 1C. A single-stage YIG filter typically will not supply the rejection characteristics required for modern sophisticated electronic systems. Therefore, it is standard practice to use multiple-section filters to achieve usable stop band shape. As noted above, a typical four-section filter may tune by varying the magnetic field through the spheres from 8 to 18 GHz with a 40 dB rejection bandwidth of 10 MHz, a 200 MHz maximum 3 dB bandwidth, and a passband insertion loss of 1 dB.

Figure 2A:
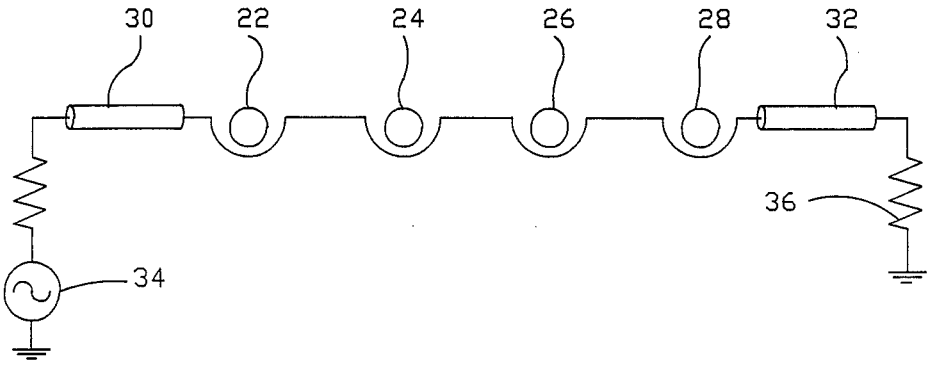
( PRIOR ART ) FIG.—2A
FIG. 2A and FIG. 2B are schematics of conventional YIG notch filters.
Figure 2B:
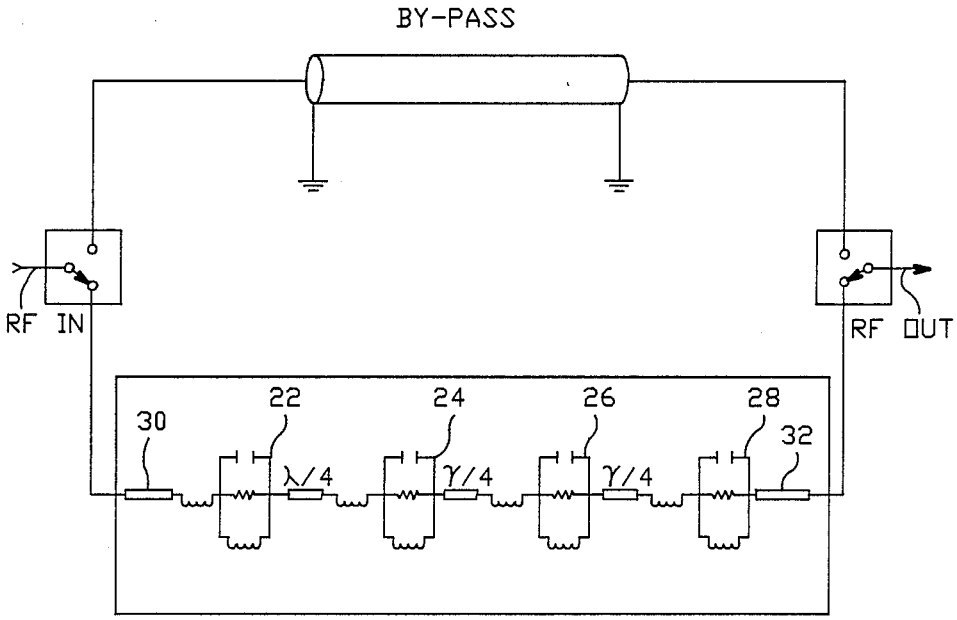
( PRIOR ART ) FIG.—2B

FIGS. 2A and 2B are schematics of such a four-section filter. Four YIG resonators 22, 24, 26, and 28 are serially connected through the transmission lines 30 and 32 to the RF source 34 and the load 36. This is similar to the circuitry of FIG. 1A. However, as illustrated in the electrical schematic of FIG. 2B, two SPDT PIN diode transfer switches 38 and 40 are provided to bypass the cascaded YIG filters, whereby the notch can be switched off at a very fast rate (less than 500 ns). Such SPDT PIN switches are conventional and commercially available, with each switch employing both series and shunt diodes. Thus, a single diode failure can render the switches and hence the receiver system inoperable. Further, the switches mean additional insertion loss to the system. In a typical system working to 18 GHz, the switches will add as much as 4 dB to the overall insertion loss of the filter. Additionally, a catastrophic failure occurs if DC power is lost to the switch. The switch is effectively open and severely attenuates all incoming signals thereby blanking the entire receiver spectrum.

Figure 3A:
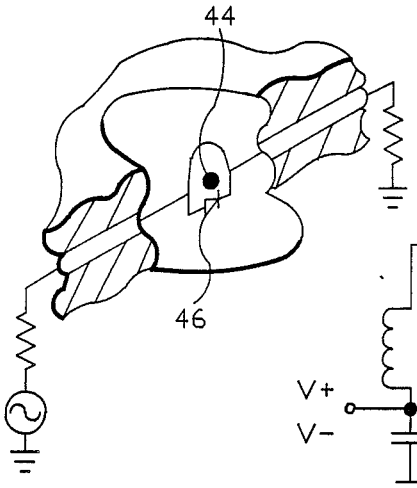
FIGS. 3A, 3B, and 3C are a perspective view in section of a notch filter as used in accordance with the present invention, an electrical schematic thereof, and frequency characteristics thereof, respectively.
Figure 3B:
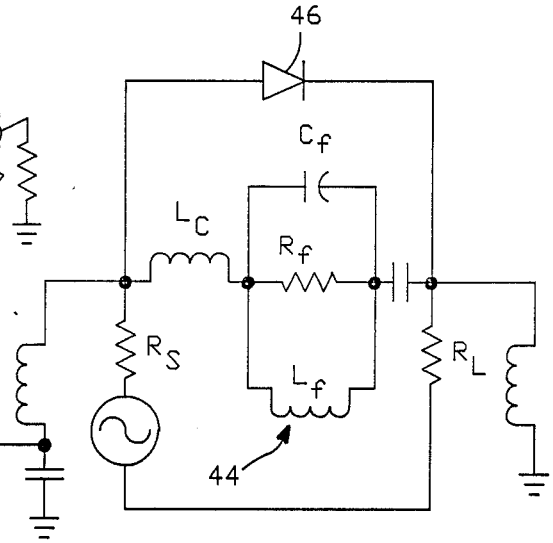
Figure 3C:
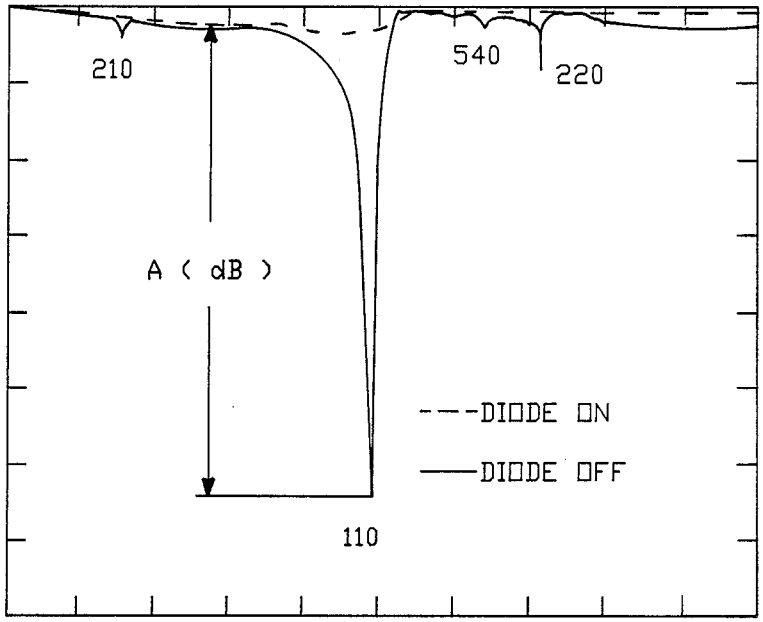

FIG. 3A is a perspective view in section of a YIG resonator 44 with a shunt PIN diode 46 as used in accordance with the present invention. In all other respects, the structure of FIG. 3A is similar to the structure of FIG. IA, and the equivalent circuit of FIG. 3B is similar to the equivalent circuit of FIG. 1B except for the addition of a shunt PIN diode 46. The filter acts normally so long as the diode is unbiased or biased off. This is illustrated by the solid line in the rejection plot of FIG. 3C. However, when the diode is turned on, it essentially short-circuits the resonance and the notch is turned off as illustrated by the dashed line in FIG. 3C. The slight amount of residual notch is a function of diode minimum forward resistance.

Figure 4A:
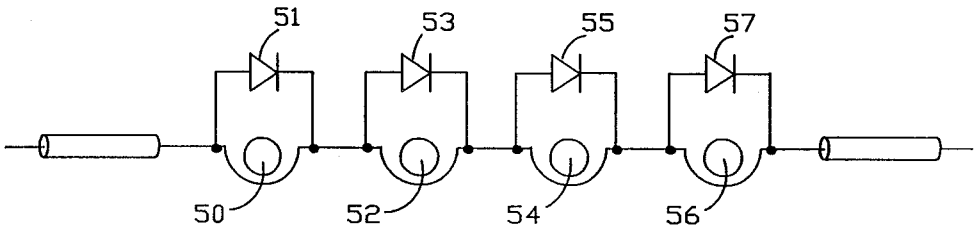
FIGS. 4A and 4B are schematics of a notch filter employing a plurality of serially-connected YIG resonators in accordance with the invention.
Figure 4B:
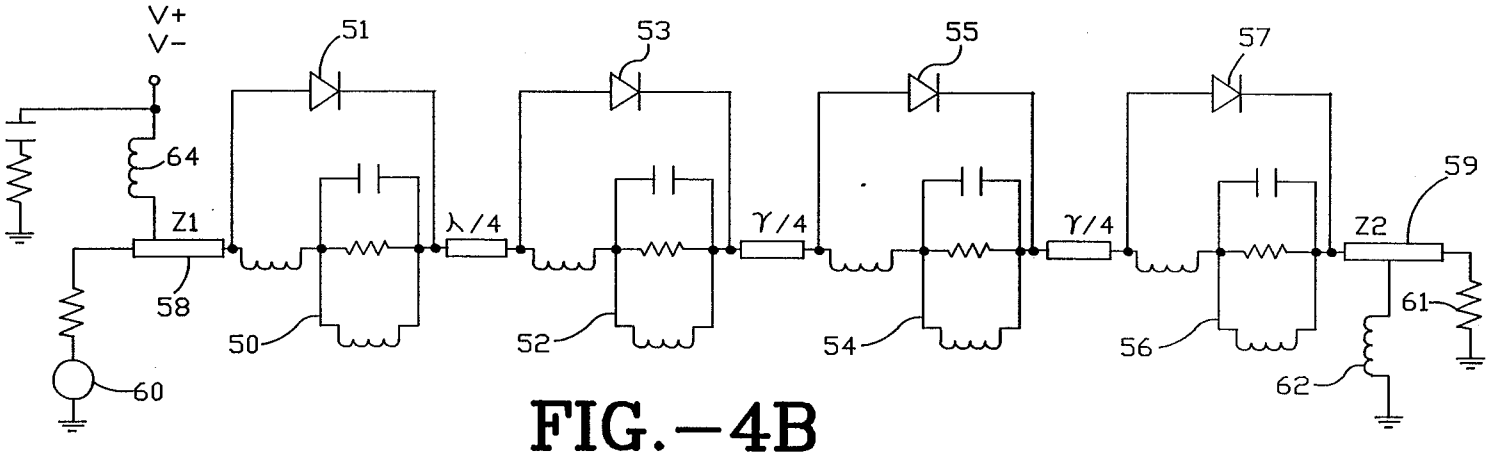
Figure 5:
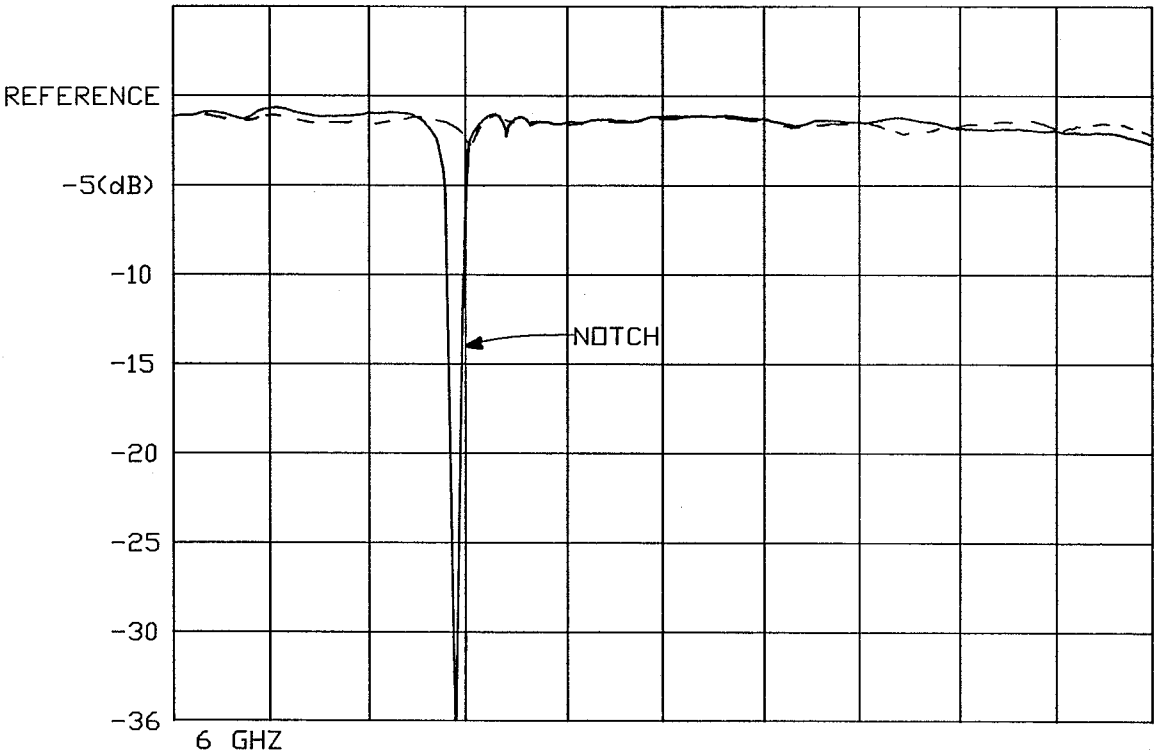
FIG. 5 is a plot of frequency characteristics of the notch filter of FIGS. 4A and 4B.

FIGS. 4A and 4B are schematics of a four-section YIG filter employing the shunted YIG resonator as illustrated in FIG. 3A. The four resonators 50, 52, 54, and 56 are respectively shunted by PIN diodes 51, 53, 55, and 57. The cascaded YIG resonators are serially connected through transmission lines 58 and 59 to the RF source 60 and load 61.

Control of the conduction of the PIN diodes is provided by grounding transmission line 59 through choke coil 62 and providing a DC bias through a choke coil 64 to transmission line 58. When a negative voltage is applied to the coil 64, the diodes 51, 53, 55, 57 are reverse-biased and are essentially removed from the circuit. However, when a positive voltage is applied to coil 64, PIN diodes 51, 53, 55, 57 are forward-biased and conduct the RF current, thereby effectively removing the YIG resonators from the circuit. When each diode is biased on, it appears as a short across the coupling loop and the RF current is now shunted away from the loop and around the resonance circuit.

Importantly, a diode failure in the form of an open or shorted diode will affect the degree to which the notch is disabled, but leaves the passband basically unaffected. A loss of DC power simply leaves the diodes unbiased and the filter operates normally.

A notch filter in accordance with the invention introduces a minimal increase in passband insertion loss over that of the prior-art filters. No passband insertion loss degradation occurs if DC power to the switch is lost. Further, even partial diode failure has no appreciable effect on passband insertion loss.

While the invention has been described with reference to a specific embodiment, the description is illustrative of the invention and is not to be construed as limiting the invention. For example, the DC voltage can be applied at the load end of the filter with the source end of the filter grounded. Various modifications and applications may occur to those skilled in the art without departing from the true spirit and scope of the invention as defined by the appended claims.

I claim:

1. A microwave notch filter comprising a plurality of serially connected YIG resonators, each YIG resonator including a coupling wire loop and a PIN diode connected directly in parallel with said coupling wire loop, first interconnect means for interconnecting one end of said plurality of serially connected YIG resonators to an r.f. signal source, second interconnect means for interconnecting another end of said plurality of serially connected YIG resonators to a load, inductive means connecting one or said interconnect means to a circuit ground potential, and inductive means connecting the other of said interconnect means to a DC voltage source, whereby said PIN diodes in said YIG resonators can be forward-biased or reverse-biased by a DC voltage applied to said first interconnect means.

2. The microwave notch filter as defined by claim 1 and further including quarter-wave-length transmission lines interconnecting said YIG resonators.

3. The microwave notch filter as defined by claim 1 wherein the DC voltage source selectively provides a positive DC voltage and a negative DC voltage which effectively controls the functioning of said YIG resonators.

4. The microwave notch filter as defined by claim 3 wherein said PIN diodes are serially connected with like polarities whereby application of a negative voltage reverse-biases said diodes and application of a positive voltage causes said diodes to short-circuit said YIG resonators.

5. The microwave notch filter as defined by claim 1 wherein each YIG resonator includes magnet means for establishing a first magnetic field through said YIG resonator in a first direction, said coupling wire establishing a second magnetic field through said YIG resonator in a second direction at 90° to said first direction.

6. A YIG band reject filter which can be readily switched into and out of a circuit, said filter comprising a YIG resonator, a coupling wire loop magnetically coupled to said YIG resonator, and a PIN diode connected directly in parallel with said coupling wire loop, whereby said PIN diode shorts said coupling wire and said resonator when said PIN diode is forward-biased.

7. The YIG band reject filter as defined by claim 6 and further including magnet means for establishing a first magnetic field through said YIG resonator in a first direction, said coupling wire establishing a second magnetic field through said YIG resonator in a second direction at 90° to said first direction.

* * * * *